US005961384A

United States Patent [19]

Robinson

[11] Patent Number: 5,961,384

[45] Date of Patent: Oct. 5, 1999

[54] METHOD FOR PLAYING THE GAME OF CHANCE AND SKILL

[75] Inventor: Rick Robinson, Ashley, Ill.

[73] Assignee: Richard A. Robinson, Ashley, Ill.

[21] Appl. No.: 08/909,754

[22] Filed: Aug. 12, 1997

[51] Int. Cl.[6] ..... A63F 3/00; A63F 9/22

[52] U.S. Cl. ..... 463/10; 273/274; 273/256; 273/249; 273/237; 463/25

[58] Field of Search ..... 273/274, 256, 273/243, 249, 237; 463/13, 10, 12, 25

[56] References Cited

U.S. PATENT DOCUMENTS

| | | | |
|---|---|---|---|
| 4,569,526 | 2/1986 | Hamilton | 273/242 |
| 4,887,819 | 12/1989 | Walker | 273/256 |
| 4,930,789 | 6/1990 | Harris et al. | 273/256 |

OTHER PUBLICATIONS

Leisure Genius, "The Computer Edition Of Monopoly", Virgin Mastertronics International, Inc., 1989.

*Primary Examiner*—Benjamin H. Layno
*Attorney, Agent, or Firm*—Schwegman, Lundberg, Woessner & Kluth PA

[57] ABSTRACT

The present invention relates to a game of skill and chance. The game includes a step of providing a display with a plurality of positions and directing a player to place a bet to play on an identified game of chance. A marker is provided for each player. The player is next provided with a chance device to advance the marker from one position to another. A bank and jackpot are provided for a receipt of a wager from each position on the board. A banker is provided for permitting the player to settle the wager at each position.

4 Claims, 3 Drawing Sheets

METHOD FOR PLAYING THE GAME OF CHANCE AND SKILL

BACKGROUND OF INVENTION

The present invention relates to a game of chance and skill and to a method for playing a game of chance and skill.

Games of chance have had appeal throughout history. Some games of chance have had a popularity that has endured for hundreds of years. For instance, games of chance played with cards having indicia such as hearts, diamonds, spades, and clubs have been played for over one-hundred years. Games of chance involving slot machines having indicia such as lemons, cherries, apples, and so forth, have been played for nearly one hundred years. Games of chance involving dice have also been played for more than five hundred years.

One type of conventional game of chance such as Blackjack includes a step whereby a player places a single bet on an outcome of the game. Other conventional games such as poker further include a second bet, a side bet, wherein the player bets on a particular array of cards. In a game such as craps, the player bets on particular die numbers. While skill is involved in these games, the games primarily depend upon luck in achieving particular card arrangements by following several rules of the game.

Board games such as MONOPOLY® require a player to make successful investments in property as a player's marker travels over a board in order to win the game. Players have markers that are advanced over the board multiple times until a person wins. The last individual to have MONOPOLY® money wins the game. Board games such as MONOPOLY® are typically games where skill is of greater significance than chance because the game requires a player to plan and to strategize in order to complete the game successfully.

SUMMARY OF THE INVENTION

The present invention relates to a game of skill and chance. The game includes a step of providing a display with a plurality of positions and directing a player to place a bet to play on an identified game of chance. A marker is provided for each player. The player is next provided with a means to advance the marker from one position to another. A bank and jackpot are provided for receipt of a wager from each position on the board. A means is provided for permitting the player to settle the wager at each position.

DETAILED DESCRIPTION OF PREFERRED EMBODIMENTS

Figure 1:
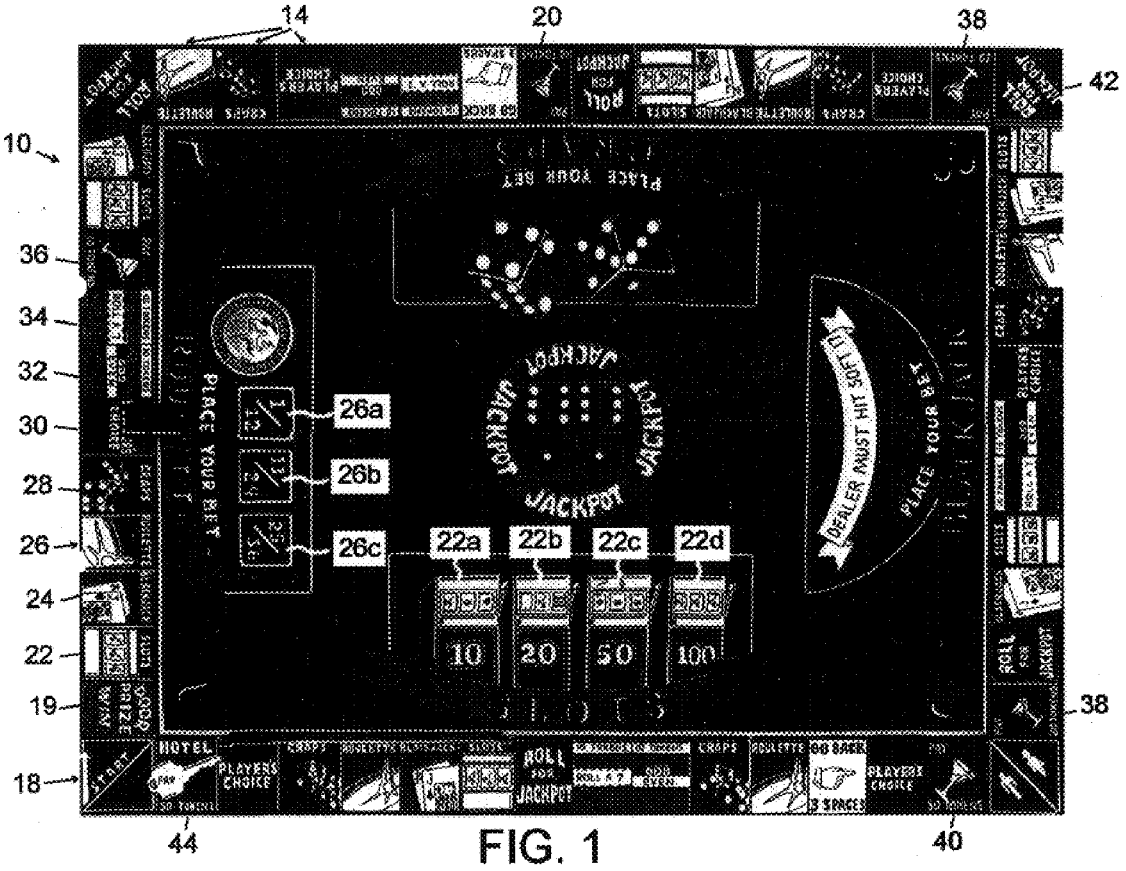
FIG. 1 illustrates a top plan view one board arrangement of the present invention.

The game of chance and skill of the present invention is played on a board such as is illustrated at 10 in FIG. 1 wherein a number of players from about two to twelve each receive a player marker which is not shown and an assortment of tokens. While tokens are described herein, it is understood that players may play with actual currency or play with tokens designating currency. The board 10 is bordered by a plurality of positions in a form of squares 14 wherein each position provides an instruction for what game of chance to play on that position. Players advance from position to position by rolling a die. Each position 14 of the game board of the present invention includes an instruction which is directed to playing a particular game of chance when the player lands on that position. In order to win the game, the player must move his or her marker over all of the positions 14 and, at the end of the game, have the greatest number of tokens.

Unlike board games such as MONOPOLY®, the player playing the game of the present invention does not have control over the outcome of his or her action at a particular position in advance of making a decision at that position. In particular, the player does not have an option of not playing the game designated at a particular position. Instead, the player must play the game of chance indicated or instructed by the position. Unlike conventional games of chance, however, the player may be required to play many varied games of chance with many different rules depending upon the position upon which the player lands. The game of the present invention requires the player to develop skill and strategy when playing one overall game that includes multiple games of chance as well as skill particular to each separate game.

In addition to the game board, such as is illustrated at 10 in FIG. 1, other equipment required for the game of the present invention includes up to the twelve individualized player markers. The player markers may be multi-colored. The player markers may also include separate and identifiable designs or shapes. Other equipment includes one white die, two red die, six green die, one deck of conventional playing cards, and one deck of roulette cards. In addition, the game includes one hundred blue tokens that count as one hundred points each, one hundred red tokens that count as fifty points each, one hundred green tokens that count as twenty points each, and one hundred yellow tokens that count as ten points each. While particular token colors are described, it is understood that one may use other colors or shapes or designs.

As discussed, in order to win, the player must collect as many tokens as possible, and more than any other player prior to reaching a "finish" position. If any player loses all of his or her tokens before reaching the "finish" position, he or she is out of the game.

At the beginning of the game, an individual is selected as a house banker and dealer. It is contemplated that this individual may be a human being or may be an electric banker or dealer. This individual pays out and collects tokens as well as deals blackjack and roulette cards. The house banker and dealer may also be a player in the game. The dealer reshuffles the cards after a player has played blackjack or roulette.

Also at the beginning of a game, each player selects a multi-colored player marker and places it on a square on the board marked Start/Finish 18. At this time, the banker issues five hundred tokens to each player. The banker also places one hundred tokens in a jackpot 20.

One player is then selected to start the game and play in a clockwise manner around the board 10. It is also possible for the player to play counter-clockwise, however. The player may be selected by any conventional method such as by volunteering, selecting a "short straw" and so on. The player selected rolls one white die and advances according to the number on the die. The player then follows the instructions on the square upon which the player has landed. The die is then passed to the next player.

If the player rolls a "one" and lands on a space marked "Door Prize" as indicated at 19 in FIG. 1, the banker pays the player ten tokens. It is noted that the order of positions shown in FIG. 1 may be subject to change without departing from the game of the present invention.

If a player rolls a "two" and lands on the spot marked "slots" 22, the player must place a bet on a slots section 22 of the board game. The player may place a bet of ten, twenty, fifty, or one hundred tokens in one of the spots marked at 22*a,* 22*b,* 22*c,* or 22*d,* respectively. Once the player has made his or her bet, the player rolls six green dice. If the player rolls a three of a kind, the player wins his or her wager. If the player rolls a four of a kind, the player wins his or her bet plus an extra fifty tokens. If the player rolls a five of a kind, the player wins his or her bet plus an extra one hundred tokens. If the player rolls six of a kind, the player wins the bet plus an extra 200 tokens.

If the player rolls a "three," the player will land on a space marked "Blackjack" 24. If the player lands on the Blackjack or "Twenty-One" position, the player must place a bet. The bet may range from ten to one hundred tokens. The bet is not optional. Once the player has placed the bet, the dealer gives the player one card face down and then deals himself one card face down. The dealer then gives the player a second card face down. The dealer's second card is turned face up. In order to win at Blackjack, the player must beat the dealer's hand. The player tries to get "Twenty-one" without going over, which is also called "busting." The player may stand on any number that the player wishes. However, the dealer must hit a "soft seventeen." A card having a value of "six" and an ace is a "soft seventeen." The dealer must stand on all other seventeens or higher. The dealer must also hit sixteen or under.

Aces count as one or eleven in this game of Blackjack. Jacks, queens, and kings count as ten. All other cards count as face value. If a player has Blackjack, that is, an ace and either a ten, a jack, a queen, or a king, the dealer pays the player double his or her wager.

In the case that the dealer and player tie, there is no winner. This is called a "push." The player takes back his or her wager. The player may decide to split his hand if he is dealt two of a kind by the dealer. For example, if the player is dealt two aces, then the player may turn both aces face up. The dealer then gives the player two more cards face down. The player then has two chances to beat the dealer. If the player decides to split his hand, the player must double his bet. If the player is dealt a two and a nine, or a three and an eight, or a four and a seven, or a five and a six, the player may go down for a double. To do this, the player doubles his bet. The dealer then gives the player one card only. If the player beats the dealer, the dealer pays the player double his bet wager.

If the player rolls a "four" on his initial roll, the player will land on the "roulette" position 26. If the player lands on the roulette position 26, the player must place a bet to play roulette. The player may bet any amount from ten to one hundred tokens. There are two options with respect to rules for playing roulette. In a first option, the player may bet either red or black. If the player bets red and the top card on the roulette card pile is a red number, the player wins the bet. If the first card is not a red card, the player loses. In a second option, the player may bet on numbers one through twelve, thirteen through twenty-four, or twenty-five through thirty-six. The player places the bet on the square of choice as indicated as squares 26*a,* 26*b* and 26*c* on board 10. The dealer then gives the player the roulette card at the top of the deck. If the player's wager is in the matching section, the player wins. The dealer pays double if the player wins roulette. The game of the present invention permits the player to bet in both roulette sections by betting on both colors and numbers if the player so chooses.

If the player rolls a die and the die is a "five," the player will play a game of "Craps" 28. If the player lands on this position, the player may bet any amount from ten to one hundred tokens. Once the player has placed a bet, the player rolls two red die. If the player rolls a "seven" or an "eleven," the player will win his or her bet. If the player rolls a "two," "three," or "twelve," the player loses. If the player rolls "four," "five," "six," "eight," "nine," or "ten," that number is the player's point, and the player must roll that same number before the player rolls a "seven." If the player rolls his or her point before rolling a "seven," the player wins his or her bet. If not, the player loses.

If the player rolls a "six" on his or her first turn, the player will land on a space marked "Player's Choice" 30. On this space, the player has the choice of playing "Slots," "Blackjack," "Roulette," or "Craps."

If in subsequent rolls of the dice, the player lands on a square marked "Ten Tokens Pay Odd Even Win 50" 32, the player must pay ten tokens to the jackpot. The player then places his or her marker on a space marked "Odd" within the playing square or a space marked "Even" within the playing square. The player then rolls one die. If the player chooses "Odd" and the roll of the die is an odd number, then the banker pays the player fifty tokens. Irrespective of whether the player wins or loses, the player's ten tokens remain in the jackpot.

If a player lands on a space marked "Roll A 7 Pay 10 Tokens Win 100" 34, the player must pay ten tokens to the jackpot. Next, the player rolls two dice. If the player rolls a "seven," the banker pays the player one hundred tokens. If the player does not roll a "seven," the player loses. Irrespective of whether the player wins or loses, the ten tokens remain in the jackpot.

If the player lands on one or more of the squares marked "Pay 10 Tokens" 36, "Pay 20 Tokens" 38, or "Pay 50 Tokens" 40, the player must pay the designated number of tokens to the jackpot.

If the player lands on a space marked "Roll For Jackpot" 42, the player rolls two red dice. If the player rolls dice having a value of two or twelve, the player wins any tokens in the jackpot. The player gets three chances to roll a "two" or a "twelve." If the player wins, the banker places another one hundred tokens in the jackpot. If the player lands on a space marked "Hotel Pay 50 Tokens" 44, the player must pay fifty tokens to the banker.

All tokens lost on Slots, Blackjack, Roulette, or Craps, are paid to the house banker/dealer. Players must reach the finish line on a roll of die. The first player to reach the finish line without going over the finish line wins one hundred bonus tokens from the banker. Other players are allowed to finish the game. When all players either finish or reach the "Hotel Square" the game is over. The player who has collected the most tokens wins the game.

The game of the present invention permits a player to play a game of chance and skill that requires a player to successfully play multiple games of chance in order to win. Unlike playing a game of Blackjack, or a game of Craps or Roulette, the player playing the game of the present invention must develop a strategy for successfully playing all of these games in order to win the overall game. This strategy may include a variable betting scheme. The game may include an added feature of a collection of spaces dispersed over the board that permit the player to increase his or her bet from ten to five hundred tokens. This is called the "five hundred token limit" section.

Unlike a conventional board game such as MONOPOLY®, the game of the present invention may be played as a game of chance in a casino. The casino game may be played with a single player against the House. The game may also be played against other players in the casino.

Figure 2:
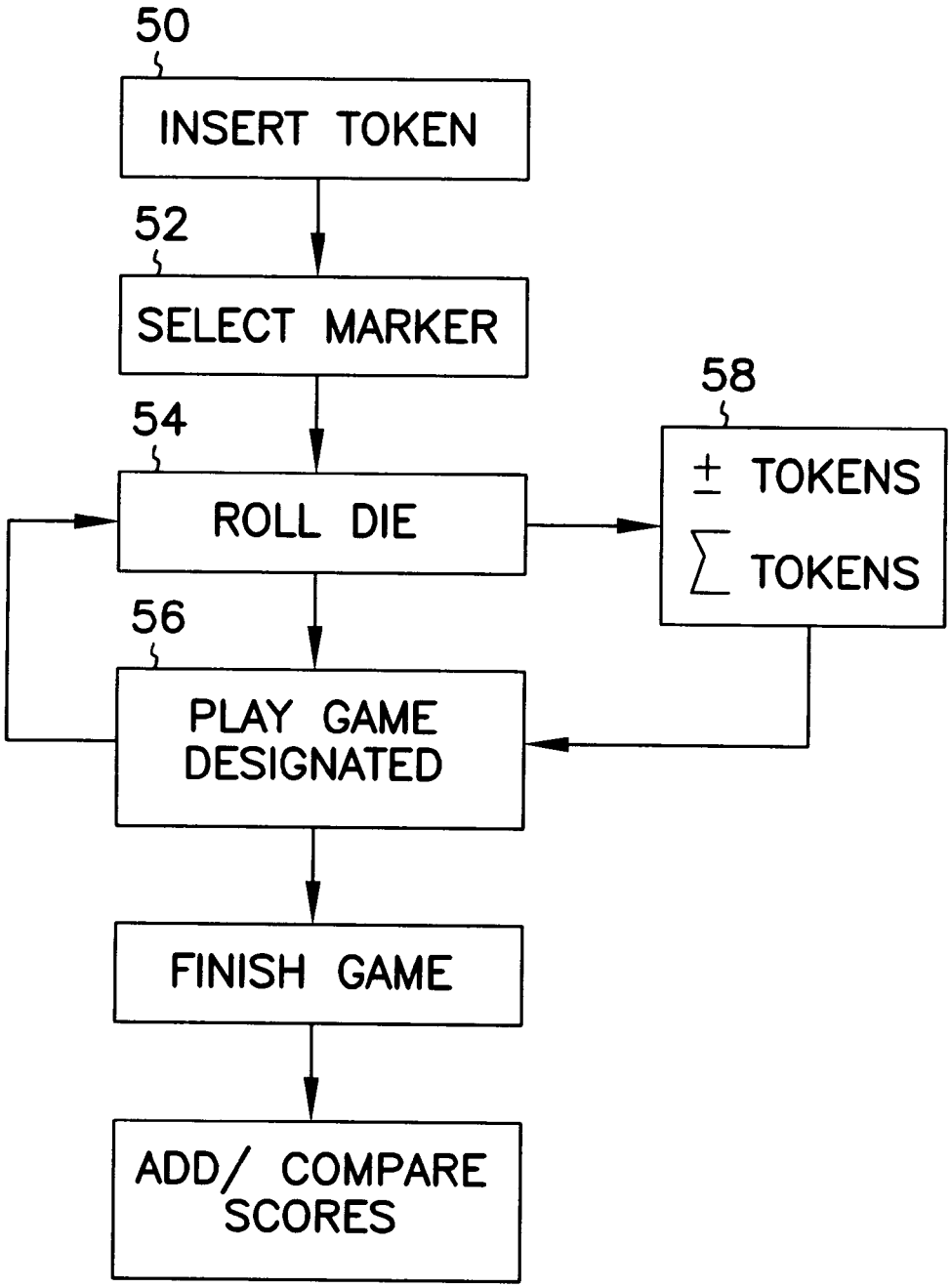
FIG. 2 illustrates a schematic embodiment of one electronic form of the game of the present invention.

While play on a conventional board has been described, it is also contemplated that the game of the present invention may be played electronically. One embodiment is illustrated schematically in FIG. 2. To play the electronic game, the player inserts a token to play at 50 and merely uses electronic markers selected at 52 that are passed around on an electronic display. For an electronic game, the player may play against the house or an electronic player as a two player game. The player may also play against other individuals on a network permitting play by up to twelve individuals at a time.

In order to play the electronic game, the player inserts a token and selects a gaming marker. The player must push a button or some sort of touch sensitive space on the gaming device that will actuate a signal to electronically roll a die as shown at 54. Once the electronic die is rolled the marker is electronically advanced to a position with instructions for playing a particular designated game as shown at 56. The player then plays the game or responds to the instructions in the position. Once the game is played, the individual's tokens are electronically added or subtracted to a running total with a computer compiler and totalizer 58. At the conclusion of the game, each player's tokens are electronically compared and the individual with the largest number of token is selected as the winner. The winner of the casino game receives a prize. The prize may be currency or additional chances to play the game of the present invention or other types of non-monetary prizes.

Figure 3:
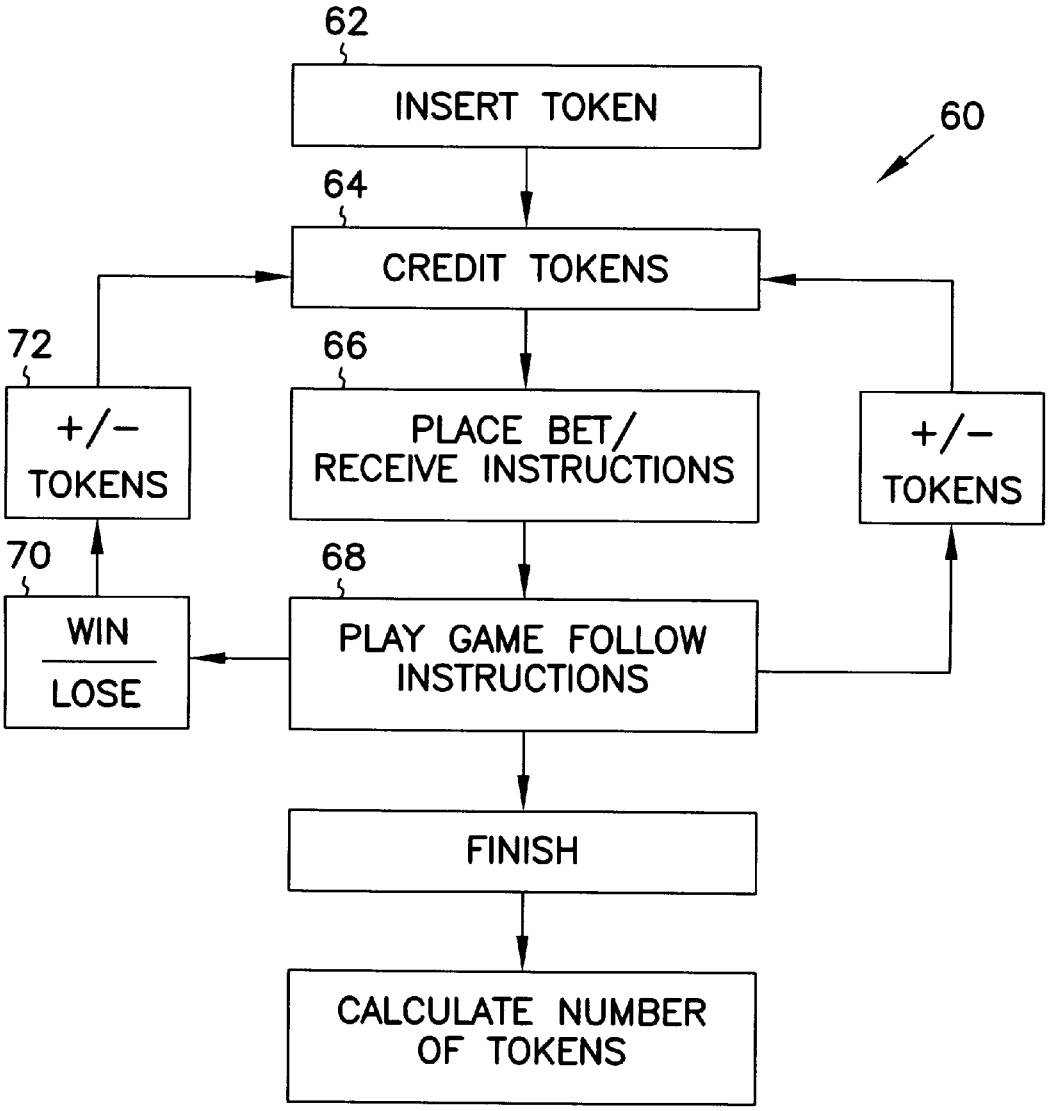
FIG. 3 illustrates a schematic embodiment of an electronic bank used in conjunction with the game of the present invention.

It is also contemplated that the game of the present invention may be played manually with players advancing markers and manipulating a die, but with an electronic banker as shown schematically at 60 in FIG. 3. The electronic banker facilitates play in a casino. For this embodiment, the player initially inserts a token in an electronic device at a position at a gaming table where the player would like to play. This token insertion is illustrated schematically at 62 in FIG. 3. The token may be inserted in a variety of conventional token receipt devices. The device receives the token and credits to the player a prescribed number of tokens for playing the game 64. These tokens are credited electronically. Once the player begins playing the game, the player will land on a position which either requires a bet or requires the player to comply with instructions such as paying tokens or receiving tokens from the bank. In one embodiment, the player may place a bet by activating a particular number uniquely associated with the position on the board 66. Actuation of this number prompts the electronic device to activate a particular sequence associated with the betting scheme and game of that position 68. The player places a bet by depositing tokens in the token receiving device 62. The electronic banker credits the player 64. Once the game is played, the player indicates whether the player won or lost 70, and the electronic banker automatically credits or debits the particular token credit of the player 72. This sequence is repeated until the game is finished. At this time, the final score for each player is revealed at his or her location.

The aforementioned description is not to be interpreted to exclude other games of skill and chance advantageously employing the present invention. Other arrangements may be desired by those skilled in the art without departing from the spirit and scope of the present invention.

What is claimed is:

1. A method of playing a casino game comprising the steps of:

inserting a token into a token receiving device which activates a token totalizer to play the game;

selecting a gaming marker;

activating the rolling of a die;

moving the marker along a board that comprises positions with instructions to a position in accordance with the roll of the die;

following instructions at the position said instructions comprising directing a player to bet a preselected amount in the form of one or more tokens to play an identified game of chance selected from a group consisting of Slots, Blackjack, Roulette, and Craps;

playing the game of chance utilizing cards, die, or a roulette wheel, as required;

crediting or debiting tokens to the token totalizer to generate a token score; and comparing the token score of each player and awarding the winning player, once a player passes a position marked "FINISH" on the board.

2. The method of playing the casino game of claim 1 wherein a step of activating the rolling of a die occurs electronically.

3. The method of playing the casino game of claim 2 wherein the moving of the marker occurs electronically.

4. The method of playing the casino game of claim 1 wherein the board is an electronic board.

* * * * *